US012729670B2

(12) United States Patent
Kirtley et al.

(10) Patent No.: US 12,729,670 B2
(45) Date of Patent: Sep. 8, 2026

(54) HYBRID GETTERING DIFFUSION PUMP

(71) Applicant: Helion Energy, Inc., Everett, WA (US)

(72) Inventors: David Kirtley, Seattle, WA (US); Anthony Pancotti, Kenmore, WA (US); Christopher James Pihl, Woodinville, WA (US)

(73) Assignee: Helion Energy, Inc., Everett, WA (US)

( * ) Notice: Subject to any disclaimer, the term of this patent is extended or adjusted under 35 U.S.C. 154(b) by 99 days.

(21) Appl. No.: 18/535,606

(22) Filed: Dec. 11, 2023

(65) Prior Publication Data

US 2024/0136165 A1 Apr. 25, 2024

Related U.S. Application Data

(63) Continuation-in-part of application No. PCT/US2022/033172, filed on Jun. 13, 2022, and a continuation of application No. PCT/US2022/033318, filed on Jun. 13, 2022.

(60) Provisional application No. 63/209,808, filed on Jun. 11, 2021.

(51) Int. Cl.

| | |
|---|---|
| ***F04B 37/04*** | (2006.01) |
| ***F04B 37/14*** | (2006.01) |
| *F04F 9/00* | (2006.01) |

(52) U.S. Cl.

CPC ..... *F04B 37/04* (2013.01); *F04B 37/14* (2013.01); *F04F 9/00* (2013.01)

(58) Field of Classification Search

CPC ..... H01J 41/16; H01J 41/12–20; F04F 9/00; F04F 37/04; F04F 37/14; F04F 9/04; F04B 37/02–04; F04B 37/14

USPC ..... 417/48–51

See application file for complete search history.

(56) References Cited

U.S. PATENT DOCUMENTS

| | | | | |
|---|---|---|---|---|
| 2,948,459 A * | 8/1960 | Ardenne | H01J 41/16 | 417/49 |
| 2,967,257 A * | 1/1961 | Milleron | H01J 41/20 | 313/558 |
| 3,009,629 A | 11/1961 | Paul et al. | | |
| 3,050,236 A * | 8/1962 | Batzer | H01J 41/12 | 417/51 |
| 3,098,155 A * | 7/1963 | Becker | H01J 41/12 | 417/51 |
| 3,134,534 A * | 5/1964 | Jancke | F04F 9/00 | 417/153 |
| 3,389,288 A | 6/1968 | Della et al. | | |

(Continued)

FOREIGN PATENT DOCUMENTS

JP H07260566 A 10/1995

OTHER PUBLICATIONS

International Search Report and Written Opinion in International Application No. PCT/US2022/033318 mailed Nov. 15, 2022, 18 pages.

(Continued)

*Primary Examiner* — Thomas Fink

(74) *Attorney, Agent, or Firm* — Kilpatrick Townsend & Stockton LLP

(57) ABSTRACT

A vacuum pump includes a liquid getter that is sprayed into a pump chamber. The sprayed liquid getter can chemically bind with gaseous substance in the pump chamber to create ultra-low pressure in the pump chamber and an attached vacuum chamber. The liquefied getter can be circulated and recycled in the vacuum pump.

14 Claims, 4 Drawing Sheets

(56) References Cited

U.S. PATENT DOCUMENTS

| | | | | |
|---|---|---|---|---|
| 3,542,489 | A | 11/1970 | Starck | |
| 3,801,225 | A | 4/1974 | Power | |
| 3,811,794 | A | 5/1974 | Dunkleberger et al. | |
| 3,957,597 | A | 5/1976 | Maroni | |
| 4,324,765 | A * | 4/1982 | Mastrup | B01D 53/34 422/163 |
| 5,161,955 | A | 11/1992 | Danielson et al. | |
| 5,209,646 | A | 5/1993 | Smither | |
| 5,212,424 | A | 5/1993 | Russell et al. | |
| 5,415,529 | A * | 5/1995 | Le Boucher | H02K 44/26 310/11 |
| 2003/0122492 | A1 | 7/2003 | Dandl et al. | |
| 2008/0089460 | A1 * | 4/2008 | Sved | G21G 1/10 376/195 |
| 2013/0078113 | A1 | 3/2013 | Chuntonov | |

OTHER PUBLICATIONS

International Search Report and Written Opinion in International Application No.PCT/US2022/033172 mailed Oct. 27, 2022 28 pages.

* cited by examiner

HYBRID GETTERING DIFFUSION PUMP

CROSS-REFERENCE TO RELATED APPLICATIONS

The present application is a bypass continuation of International Application No. PCT/US2022/033318, filed Jun. 13, 2022, entitled "Hybrid Gettering Diffusion Pump," and a continuation-in-part of International Application No. PCT/US2022/033172, filed Jun. 13, 2022, entitled "Hybrid Gettering Diffusion Pump." International Application No. PCT/US2022/033172 and International Application No. PCT/US2022/033318 each claim the priority benefit, under 35 U.S.C. § 119(e), of U.S. Application No. 63/209,808 filed Jun. 11, 2021, titled "Hybrid Gettering Diffusion Pump." Each of these applications is incorporated herein by reference in its entirety.

BACKGROUND

There exist a variety of vacuum pumps for creating sub-atmospheric pressures in vacuum chambers for research and industrial applications. Among the different types of vacuum pumps are positive displacement mechanical vacuum pumps, diffusion pumps, turbo-molecular pumps, and gettering pumps. Positive displacement pumps (such as rotary vane and diaphragm pumps) operate by compressing a volume of gas and expelling the compressed gas to atmosphere. These types of pumps are typically the lowest cost per pumping volume, can have high pumping speeds, and can be used for large vacuum chambers. However, positive displacement pumps are limited to lowest pressures of approximately $10^{-3}$ Torr. Diffusion pumps, in part, and turbo-molecular pumps operate by imparting kinetic energy to gaseous molecules to drive them out of a vacuum environment. Diffusion pumps also use a hot vapor to capture and transport molecules of gas toward a foreline port in the pump where the molecules can be evacuated. Diffusion and turbo-molecular pumps can achieve significantly lower pressures (down to $10^{-7}$ Torr or lower), but at lower pumping speeds and can have difficulties removing some gases, such as hydrogen.

Gettering or entrapment pumps can be better suited for removing particular gases and achieving ultra-low pressures (below $10^{-10}$ Torr), but typically have low pumping speeds and are limited to small volumes. Gettering pumps operate by exposing a chemically active component, such as a stationary titanium electrode, to a vacuum environment, ionizing gases in the vacuum and applying a bias to draw the ionized gases to the electrode where they bind with the titanium and are trapped. Another approach is to sublimate getter material, such as titanium, onto walls of a pump or a chamber where it can react with and trap gaseous substances. Gettering pumps are typically initiated after a very low pressure has already been established with a diffusion or turbo-molecular pump. Another type of entrapment pump is a cryogenic pump, which operates by adsorbing gas to a cryogenically-cooled surface. Gettering/entrapment pumps typically require regular replacement of consumables (such as the getter material or liquid gas coolants) which adds to the cost and complexity of operating such pumps.

SUMMARY

The described implementations relate to a hybrid gettering diffusion pump in which a liquefied getter is sprayed into a chamber to chemically bind with at least one gaseous substance and to achieve ultra-low pressures in vacuum chambers. The hybrid pump can perform vacuum pumping by entrapment and transfer of the gaseous substance and can have no moving parts. The liquefied getter can be circulated (reused) within the hybrid pump during operation and also can be recycled, so that pump operation may be over 100 hours or more before the getter needs servicing or replacing. Gettering action can be obtained without ionizing the getter liquid nor the gaseous substance.

Some implementations relate to a vacuum pump comprising a pump chamber, a pump wall surrounding the pump chamber, and a getter region to hold a getter. The getter region can be coupled to the pump chamber. The vacuum pump can further include a heater that is thermally coupled to the getter region to liquefy the getter in the getter region and at least one injector fluidically coupled to the getter region and arranged to spray liquefied getter from the getter region into the pump chamber.

Some embodiments relate to a method of operating a vacuum pump. The method can include acts of: liquefying a getter to form a liquefied getter in a getter region of the vacuum pump; reducing a pressure in a pump chamber of the vacuum pump below a threshold value; injecting the liquefied getter into the pump chamber to chemically bind with a gaseous substance in the pump chamber and to remove the bound gaseous substance from the pump chamber, wherein the chemical binding forms a getter product; and receiving the liquefied getter sprayed into the pump chamber and the getter product in the getter region.

All combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. The terminology explicitly employed herein that also may appear in any disclosure incorporated by reference should be accorded a meaning most consistent with the particular concepts disclosed herein.

BRIEF DESCRIPTIONS OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar components).

DETAILED DESCRIPTION

Figure 1:
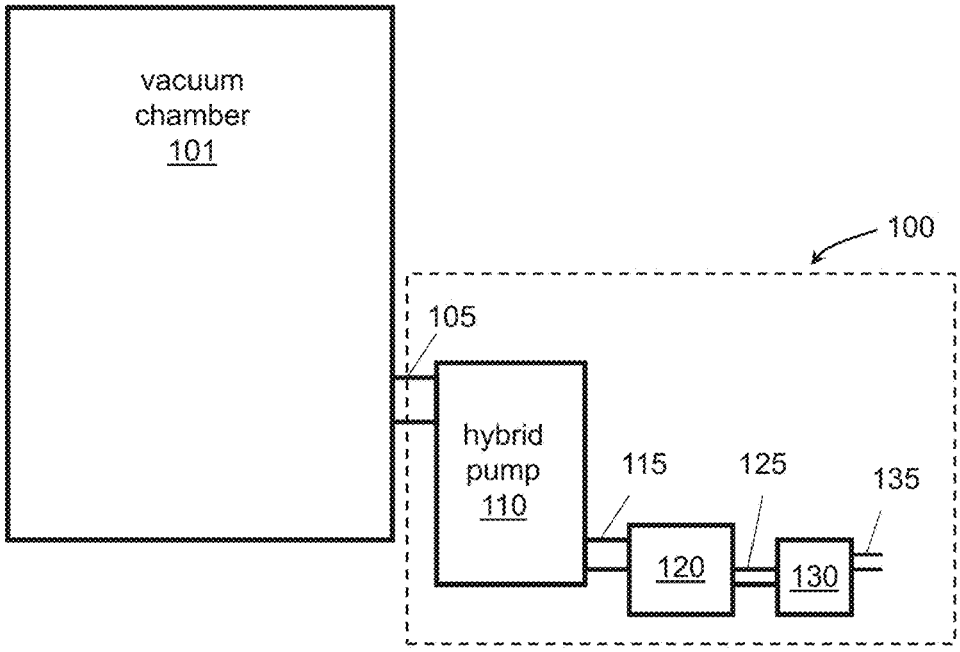
FIG. 1 depicts a vacuum-pumping system that includes a hybrid gettering diffusion pump.

FIG. 1 depicts a vacuum-pumping system 100 that can be used to create a vacuum environment in a vacuum chamber 101 in which a process can be performed. The vacuum-pumping system can be used for applications where a low base pressure (e.g., less than $10^{-6}$ Torr), high pumping speed, and continuous pumping are needed. Some example processes that can be performed in the vacuum chamber 101 include, but are not limited to, creating plasmas, plasma processing, fusion, creating x-rays or extreme ultraviolet radiation, creating beams of electrons or ions, in-space propulsion system testing, space environment simulation systems, and low-pressure chemical or nuclear reactions. In some cases, the vacuum chamber 101 may be used to house (or may be part of) a scientific instrument such as, but not limited to, an ion spectrometer, an ion-beam or electron-beam lithography or microscopy tool, an extreme ultraviolet (EUV) or soft X-ray source, EUV or soft X-ray diagnostic or imaging equipment, a cyclotron, a reactor, a particle accelerator, among other applications. The vacuum chamber 101 may be formed, at least in part, from stainless steel, another metal, a glass, a ceramic, or some combination thereof. The vacuum-pumping system 100 can connect to a vacuum port 105 of the vacuum chamber 101 (e.g., via one or more ConFlat® flanges and/or one or more vacuum couplings).

The vacuum-pumping system 100 can include at least one hybrid gettering diffusion pump 110 (examples of which are described in further detail below) and at least one backing pump 120. The backing pump 120 may be a mechanical, positive-displacement pump such as a rotary vane pump or diaphragm pump. However, one or more pumps may be used as the backing pump 120. For example, a diffusion pump or turbo-molecular pump can be used as a first backing pump, which in turn may be backed by a mechanical pump (a second backing pump). The backing pump 120 can be coupled to the hybrid pump 110 via a foreline 115, which can comprise one or more CF flanges (ConFlat® flanges) and/or one or more vacuum couplings.

In some cases, one or more purifiers 130 may connect to the exhaust port 115 of the backing pump 120 used in the vacuum-pumping system 100. A purifier can be a catalytic converter, scrubber, adsorber, electrostatic precipitator, etc., or some combination thereof. The purifier(s) 130 can remove potentially harmful gaseous components from an exhaust of the backing pump 120. For example, the purifier(s) 130 may employ heat and/or catalytic conversion to remove harmful gaseous components from an exhaust of the backing pump 120. In some cases, the purifier(s) 130 may connect to or be incorporated in an exhaust port 125 of the backing pump 120. An outlet 135 of the scrubber or converter may exhaust to a local atmospheric environment. If a purifier(s) 130 is not used, the exhaust port 125 of the backing pump 120 may exhaust to a local atmospheric environment.

Although FIG. 1 depicts one vacuum-pumping system 100 connected to a vacuum chamber, the vacuum-pumping system is not so limited. There may be one or more vacuum-pumping systems 100 connected in parallel to a common vacuum chamber 101. Additionally or alternatively, there can be one or more backing pumps 120 connected in parallel to one or more hybrid gettering diffusion pump(s) 110. Depending on the choice of getter material, special considerations may be needed when operating the pumping system 100. For example, if lithium is used as the getter, then care must be taken to prevent exposure of the lithium to water or water vapor at the hybrid pump 110 as well as upstream or downstream of the hybrid pump.

Figure 2:
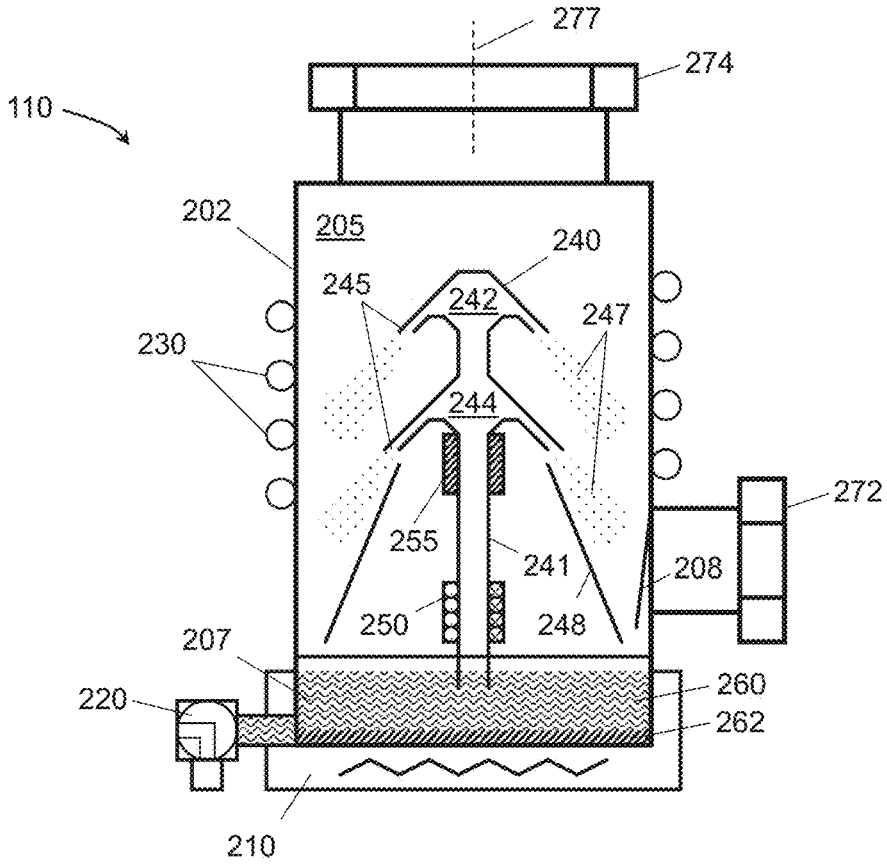
FIG. 2 depicts an example of a hybrid gettering diffusion pump.

FIG. 2 depicts an example of a hybrid gettering diffusion pump 110. The illustration is intended to roughly represent a cross-sectional, elevation view that depicts apparatus inside and outside the pump 110. The hybrid gettering diffusion pump 110 can include a pump wall 202 that surrounds, at least in part, a pump chamber 205. The pump wall 202 and pump chamber 205 may be cylindrical in shape, though other shapes are possible (square, rectangular, hexagonal, polygonal, etc.). The hybrid pump 110 can include a vacuum port coupler 274, a foreline coupler 272, and can further include an injection shroud 240 to spray getter liquid 260 into the pump chamber 205 creating getter spray 247. The getter spray 247 may contain micron-sized and sub-micron-sized droplets of the liquefied getter 260. In some cases, the getter liquid 260 may be heated or super-heated to a vapor form and sprayed into the chamber as the getter spray 247. In some cases, the heating may be done using an arc discharge. The hybrid pump 110 may further include a getter region 207 into which the getter liquid 260 and a getter product 262 can collect. The getter region 207 can, in some cases, be a region of the pump chamber 205, and in other cases comprise a secondary chamber that can be isolated from the pump chamber 205 by a wall and one or more valves 312 (see FIG. 3). The getter product 262 can be produced by a chemical reaction of the getter spray 247 with a gaseous substance (such as hydrogen or oxygen) in the pump chamber 205.

The hybrid pump 110 can also include a heater 210 that is used to liquefy the getter 260 to generate the getter liquid, so that it can be circulated within the hybrid pump and sprayed from the injection shroud 240. In some implementations, fluid lines 230 may be in thermal contact with the pump wall 202 to assist in cooling or heating getter spray 247 that strikes the pump wall. The fluid lines 230 may carry coolant fluid or a heating fluid to cool or heat the pump wall 202, depending upon the ambient temperature and the getter used in the hybrid pump 110. The term "getter" may be used herein as a shorthand reference to "getter material."

The heater 210 can be in thermal contact with the getter region 207 that contains getter liquid 260 when heated. In some implementations, the heater 210 may be in thermal contact with a portion of the pump wall 202 that extends beyond the getter region, e.g., to a region where the getter spray 247 strikes the pump wall 202. In some cases, fluid lines 230 may not be present and instead heating by the heating element 210 may be used to maintain the getter in at least a liquid state in the pump chamber 205 and prevent solidification of the getter on the interior of the pump wall 202. The use of heating or cooling around the pump chamber can depend upon the choice of getter and the phase and temperature of the getter introduced into the pump chamber 205 and may further depend on the ambient temperature around the pump.

An example getter that may be used in a hybrid gettering diffusion pump 110 is lithium, which can be used to effectively remove air molecules, hydrogen, and deuterium from a vacuum chamber 101. Lithium may be liquefied at temperatures over 180.5° C. for operation in the hybrid pump. In some cases, micron and/or sub-micron droplets of lithium can be sprayed into the pump chamber 205 to chemically bind with hydrogen and deuterium, if present, forming a chemical compound such as lithium hydride (LiH). The micro-droplets of the liquefied getter can be chemically reactive at a variety of operational conditions, including in vacuum and at room temperature. In some implementations, the reaction does not require ionization apparatus in the hybrid pump 110 to ionize either the getter or the gaseous substance. The getter product 262 may be a solid or liquid which can fall or be captured and transported by the liquefied getter to the getter region 207. In some cases, the getter product 262 forms as particulates from the getter spray 247. In the getter region 207, the getter product 262 may precipitate and/or settle out of the getter liquid 260 for subsequent removal.

Additionally, micro-droplets of the getter may, in part, collide with and impart kinetic energy to some air molecules that have wandered into the pump chamber 205 from the vacuum chamber 101. The imparted kinetic energy may move the air molecules toward the foreline coupler 272. This molecular flow may elevate the pressure in the vicinity of the foreline coupler 272 where the air molecules can be evacuated by the backing pump 120. One or more foreline baffles 208 may be present near the foreline coupler 272 to help prevent the flow of getter micro-droplets into the foreline and to the backing pump 120. In some implementations, the foreline baffle 208 can include cooling (e.g., down to liquid nitrogen temperatures or even to cryogenic temperatures) and act as a trap for particulates and/or contaminants. The foreline baffle can be a Chevron or venetian blind type baffle in some cases. However, the foreline baffle(s) 208 may not be included in some implementations. As such, the hybrid pump 110 can evacuate gases by both chemical (reacting to form a chemical compound) and physical energy-transfer (inducing molecular flow by collisions) processes. The hybrid gettering diffusion pump 110 can achieve and exceed pumping speeds of conventional diffusion pumps having a same physical size and achieve pressures that are lower by up to two orders of magnitude or more.

In some cases, a gettering diffusion pump 110 may not include the foreline coupler 272. Instead, the backing pump 120 can connect somewhere else to the vacuum chamber 101 to reduce pressure in the vacuum chamber 101 and in the pump chamber 205. In such cases, gaseous substances that are entrapped by the getter spray 247 are transferred and removed into the getter liquid 260. In such cases, the pump 110 can remove gaseous substances by entrapment and not by diffusion and evacuation from the pump chamber 205 by a backing pump 120.

In some cases, the getter material may be deployed in forms other than a liquid spray of micro-droplets. For example, the getter may be deployed as a solid (e.g., dust, powder, pellets, nanostructures, or rods) in the form of a catalyzer or gettering bed that is introduced to the pump chamber 205. In a liquid form, the getter may be deployed as droplets, vapor, a shower, or stream to form the getter spray 247. In some implementations, the droplets may be charged.

Another example of a getter may be sodium or other alkali metals. Other atomic elements, chemical compounds, or alloys may be used in some cases to target particular gaseous substances. In some cases, barium, cobalt, aluminum, magnesium, calcium, strontium, phosphorus, zirconium, vanadium, or some combination thereof may be used as getter material(s). In some implementations, Pb—Li, barium alloys, Ti—Sn—Al, Zr—Cu—Al, $UF_6$, uranium alloys, gallium alloys, and FLiBe/FLiNaBe/FLiNaK may be used as getter material. Example gases which may be pumped by one or more of these materials include H, CO, $CO_2$, $N_2$ $O_2$, N, O, organic vapor, and hydrocarbons.

The getter liquid 260 may be introduced into and removed from the getter region 207 through one or more fluid ports 220. A fluid port can include a fluid line (e.g., metal, ceramic, or glass tubing) and/or a fluid valve. Getter product 262 may be removed through one or more fluid ports 220 (e.g., by flushing the getter region or using another process described below).

In some implementations, the getter product 262 may be removed when the hybrid pump 110 is not in use and is valved off from the vacuum chamber 101 and backing pump 120. The hybrid pump 110 may be placed in a getter-exchange state where the hybrid pump may not be producing getter spray 247. The heater 210 may heat the getter liquid 260 and getter product 262 to a temperature that liquefies both the getter and the getter product 262. For example, if lithium is used as the getter and lithium hydride is produced, the getter and getter product 262 may be heated to a temperature over 692° C. to liquefy both the getter and getter product. Once liquefied, both the getter liquid 260 and liquefied product 262 can be purged from the getter region 207 and new getter liquid introduced. To maintain vacuum on the vacuum chamber 101 during such a getter exchange, two or more hybrid pumps 110 can connect in parallel to the vacuum chamber. One of the hybrid pumps can be valved off and isolated for a getter exchange while the remaining hybrid pump(s) continue pumping on the vacuum chamber 101.

The injection shroud 240 may be formed, at least in part, from metal, ceramic, glass, refractory material, or some combination thereof, and can include a feed tube 241 that can draw getter liquid 260 from the getter region 207 and transport the getter liquid 260 toward one or more injectors 245. The injectors 245 may be formed as part of the injection shroud 240 (e.g., as small holes formed in the shroud) or may attach to the shroud (e.g., as one or more injection or spray nozzles). The injectors 245 may be arranged in an annular pattern, having a plurality of holes extending along a ring inside the pump chamber 205 for a cylindrically-shaped pump chamber. Other patterns and shapes may be used for pump chambers 205 that are not cylindrical. In some implementations, the injectors 245 may comprise a plurality of discrete nozzles distributed along a ring around the interior of the pump chamber 205. The injectors 245 can eject getter spray 247 at high velocity into the pump chamber 205 and generally toward the foreline coupler 272, as depicted in FIG. 2.

There can be one, two, or more tiers of nozzles 245 within the pump chamber 205 that provide stages of pumping. In the illustrated example, a first tier of injectors 245 provide a first stage 242 of pumping. A second tier of injectors 245 provide a second stage 244 of pumping.

The hybrid pump 110 may include a chamber baffle 248 that can assist in elevating the pressure in the vicinity of the foreline coupler 272 (e.g., by pinching the flow of micro-droplets and gaseous substance into a narrowing space between the chamber baffle 248 and foreline baffle(s) 208. The chamber baffle 248 may also assist in liquefying getter, in some cases. For example, the chamber baffle 248 may be in thermal communication with the pump wall 202 (by one or more thermally-conductive fins) and operated at a temperature that liquefies getter spray upon contact. The chamber baffle 248 may or may not physically contact the injection shroud 240.

The hybrid gettering diffusion pump 110 can further include a liquid pump 250 to force getter liquid 260 under pressure to the injectors 245. The elevated pressure differential across the injectors can assist in atomizing the getter liquid into a getter spray 247 of micro-droplets and sub-micro-droplets. An example pump 250 that can be used is an electromagnetic induction pump, which can pump a conductive liquid. Further details of the pump 250 are described below. In some implementations, the injectors 245 may be vibrated ultrasonically (e.g., with piezoelectric transducers) to further assist in dispersing the getter liquid 260 into a getter spray 247 of microdroplets and sub-microdroplets.

In some cases, an auxiliary heater 255 may be included along the feed tube 241 to further elevate the temperature (and possibly pressure) of the getter liquid 260 prior to ejection from the injectors 245. The heater 255 may comprise a resistive element through which electrical current flows and produces ohmic heat. In some cases, a magnetic induction heater may be used additionally or alternatively as the heater 255.

For some implementations, the heater 255 may be used additionally or alternatively to the pump 250. For example, the heater 255 may be operated at a temperature that vaporizes the getter liquid 260, thereby creating a pressurized gaseous getter vapor within the injection shroud 240 that is ejected from the injectors 245. For example, when lithium is used as the getter, the heater 255 may increase the temperature of the liquid lithium to over 1342° C.

Figure 3:
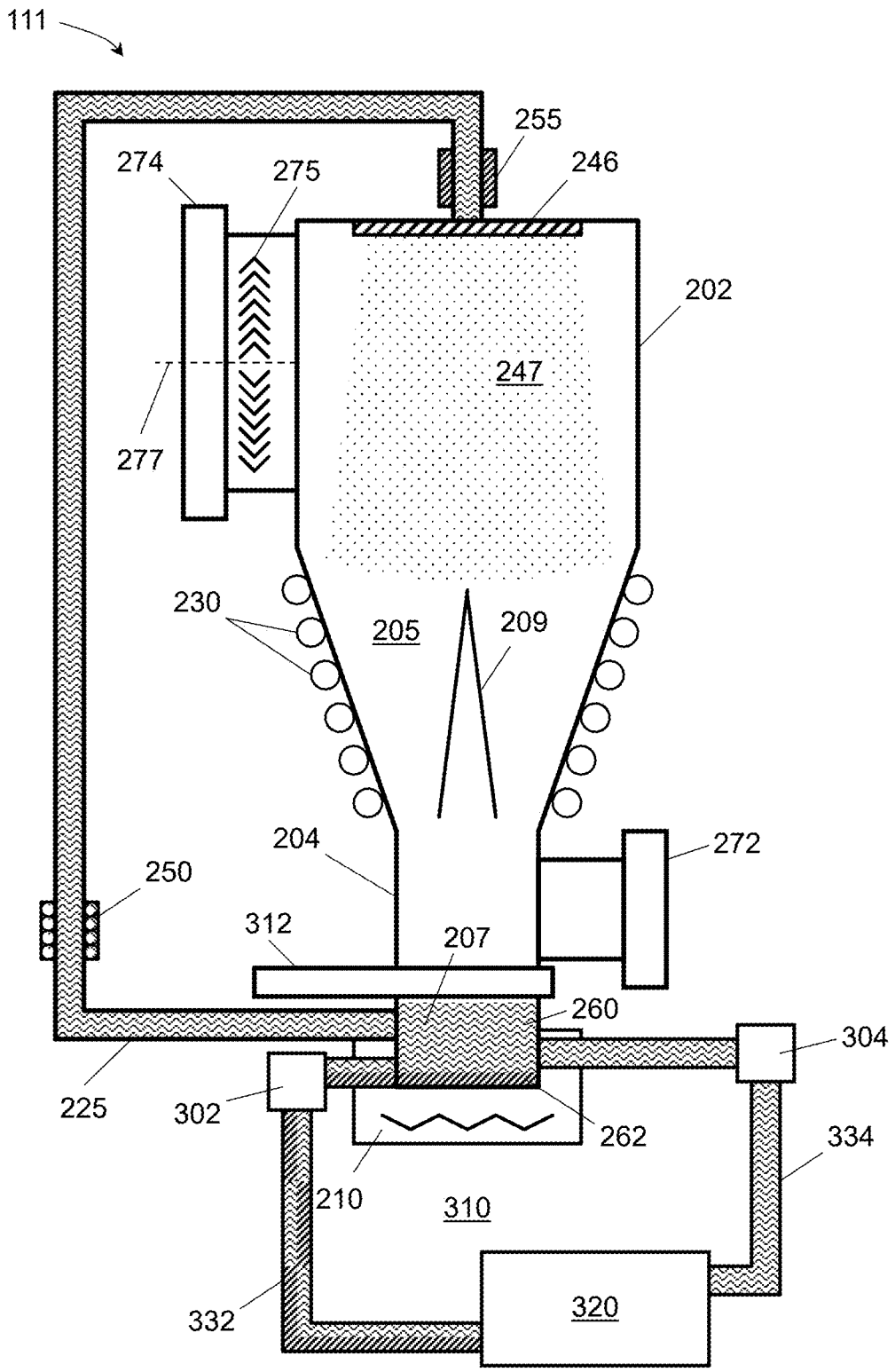
FIG. 3 depicts an example of a hybrid gettering diffusion pump that includes getter processing.

FIG. 3 depicts an example of a hybrid gettering diffusion pump 111 that includes getter processing. Generally, the shape and architecture of a hybrid gettering diffusion pump may be different than the shapes shown in FIG. 2 and in FIG. 3. In FIG. 3, the hybrid pump 111 can have a cylindrical wall 202 (though other shapes are possible as described above) that tapers to a narrowed portion 204 near the foreline coupler 272. The narrowing of the pump wall 202 can assist in elevating pressure near the foreline coupler 272 and may aid in the collection and liquefication of getter spray 247 before it reaches the foreline port and coupler 272. Foreline baffle(s) 208 may or may not be included in the implementation of FIG. 3. The hybrid gettering diffusion pump 111 may or may not include a chamber baffle 209. When included, the chamber baffle 209 may assist in the collection and liquefication of the getter spray 247, as described above for the chamber baffle 248. The chamber baffle 209 may be in thermal communication with the pump wall 202 (e.g., via one or more thermally-conductive fins that connect between the pump wall 202 and chamber baffle 209).

Either of the hybrid pumps depicted in FIG. 2 and FIG. 3 may or may not include a vacuum port baffle 275 (such as a Chevron or venetian blind type baffle). The vacuum port baffle 275 may help prevent the backstreaming of getter spray 247 particles and/or gaseous substances through the vacuum port coupler 274 and into the vacuum chamber 101. When in operation, the pressure in the pump chamber near the vacuum port coupler 274 will be lower than the pressure in a vacuum chamber 101 to which the hybrid gettering diffusion pump 111 is connected. The getter spray 247 is directed away from or approximately or exactly perpendicular to the vacuum port coupler 274, so that the spray will not directly enter and pass through the vacuum port coupler 274. For example, the average direction of the getter spray can be from 90 degrees to an axis 277 of the vacuum port coupler 274, as depicted in FIG. 3 up to 180 degrees (aligned with the axis of the vacuum port coupler 274 and directed away from the vacuum port coupler 274) as depicted in FIG. 2. Because of the pressure differential, gaseous substances will generally flow from the vacuum chamber 101 towards the pump 111 and then be captured and/or swept by the getter spray 247 towards the foreline coupler. However, there is a possibility due to atomic collisions that some atoms or particles from the spray can be redirected and backstream or head toward the vacuum port coupler 274 and vacuum chamber 101. The vacuum port baffle 275 can provide an obstacle to interfere with such backstreaming particles or atoms. For example, the particles or atoms can collide with fins of the vacuum port baffle 275 and be redirected away from the vacuum port coupler 274 and vacuum chamber 101. In some implementations, the vacuum port baffle 275 can include cooling (e.g., down to liquid nitrogen temperatures or even to cryogenic temperatures) and act as a trap for particulates and/or contaminants.

For the implementation of FIG. 3, a getter feed tube 225 can be used to transport getter liquid 260 from the getter region 207, external to the pump chamber 205, toward one or more spray heads 246 located in the pump chamber 250. The getter feed tube 225 may comprise a metal, ceramic, glass, refractory material, or some combination thereof, and may be heated to maintain the getter in at least a liquid phase. Having the getter feed tube 225 external to the vacuum chamber 205 can provide easy access to, monitoring of, and replacement of the liquid pump 250 and auxiliary heater 255, if present.

The spray head 246 may comprise a plurality of injectors (e.g., injection or spray nozzles or micro-scale holes), which may be distributed across a majority of a cross-sectional area of the pump chamber 205 where the spray head is located. In some cases, the injectors may lie along a planar surface or along a portion of a spherical surface. In some implementations, a single or multi-stage arrangement of injectors, like that shown in FIG. 2, may be used alternatively or additionally.

Getter processing may be implemented with a getter loop 310 that includes a getter processor 320 fluidically coupled to the getter region 207 of the hybrid pump. The getter processor 320 may be referred to as a precipitator, filter, centrifuge, or some other term in some implementations. Getter processing may or may not be implemented with either hybrid pump depicted in FIG. 2 and FIG. 3. The getter processor can be fluidically coupled using a getter return tube 332, a getter feed tube 334, and fluid valves 302, 304. The fluid valves may be used to isolate the getter processor 320 from the getter region 207. There may be additional valves and tubing to supply or purge getter and/or getter product from one or both of the getter region 207 and getter processor 320. When operated with internal circulation of the liquefied getter and/or getter processing, the working life of a getter can be significantly extended. Operation of the hybrid gettering diffusion pump may be up to 100 hours or more without the need to replenish or replace the getter. For example, the gettering diffusion pump may undergo continuous operation for a period of time having a value in a range from 10 hours to 5,000 hours without replacing the getter or liquefied getter.

In some implementations, the getter processor 320 may perform liquid/solid-phase separation. In some cases, the separation may be performed by filtration. Additionally or alternatively, the separation may be performed by precipitation, agglomeration, sedimentation, centrifugation, chemical reaction, using an arc discharge to vaporize the precipitate, electrolysis, oxidation, another suitable process, or some combination of these processes. One example method for recovering lithium-tritide from molten lithium metal that uses a combination of steps is described in U.S. Pat. No. 3,957,597 filed May 28, 1974, titled "Process for Recovering Tritium from Molten Lithium Metal," which is incorporated herein by reference in its entirety.

In some implementations, the getter processor 320 may additionally or alternatively perform gas/liquid-phase separation. For example, the getter processor 320 may heat the getter liquid 260 and getter product 262 received from the getter region 207 to a temperature that releases the entrapped substance (e.g., releases hydrogen that is bound to lithium). In some cases, chemical methods may be used to extract or separate the getter product from a pure form (liquid or vapor) of the getter.

Figure 4:
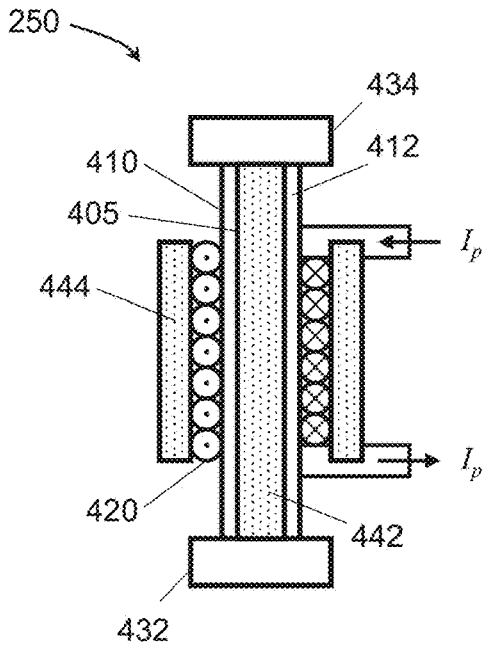
FIG. 4 depicts an example of an electromagnetic induction pump that can be used to pump a conductive getter liquid.

FIG. 4 depicts an example of an electromagnetic induction pump 250 for a getter liquid. The liquid pump 250 may include a length of non-magnetic metal, ceramic, glass, or refractory material tubing 410 and a multiphase coil 420 wound around the tubing. Inside the tubing 410 and spaced apart from its interior wall is an inner tube 405 containing a first ferromagnetic structure 442. An annular sheath 412, through which liquid getter can flow, is located between the interior wall of the tubing 410 and an outer wall of the inner tube. An outer ferromagnetic structure 444 may surround the multiphase coil 420 to form a magnetic circuit in which a magnetic field produced by the coil 420 jumps the gap across the sheath 412 between the two ferromagnetic structures 442, 444. The electromagnetic pump can include couplers 432, 434 at ends of the tubing 410, so that the pump 250 can be installed and removed from an existing system. For example, the pump can be attached to flow lines that carry liquefied getter.

In operation, the multiphase coil 420 may carry a three-phase alternating current $I_p$ that can be supplied to the coil 420 to force a conductive fluid through an annular sheath 412 within the tubing 410. The alternating currents applied to the multi-phase coil induces a travelling magnetic field axially along the tubing 410. Magnetic field in the sheath 412 induces eddy currents in the conductive liquid located in the sheath, which in turn provide an electromotive force component on the conductive liquid in an axial direction along the sheath. An advantage of including an electromagnet pump 250 in a hybrid pump 110, 111 is that pressure and flow of getter liquid 260 to the injectors can be controlled independently of temperature of the getter liquid. Another example of an induction pump is described in U.S. Pat. No. 5,209,646 titled "Electromagnetic Induction Pump for Pumping Liquid Metals and Other Conductive Liquids," issued May 11, 1993, which patent is incorporated herein by reference in its entirety. Such a pump may achieve pressures over 5000 Torr.

Figure 5:
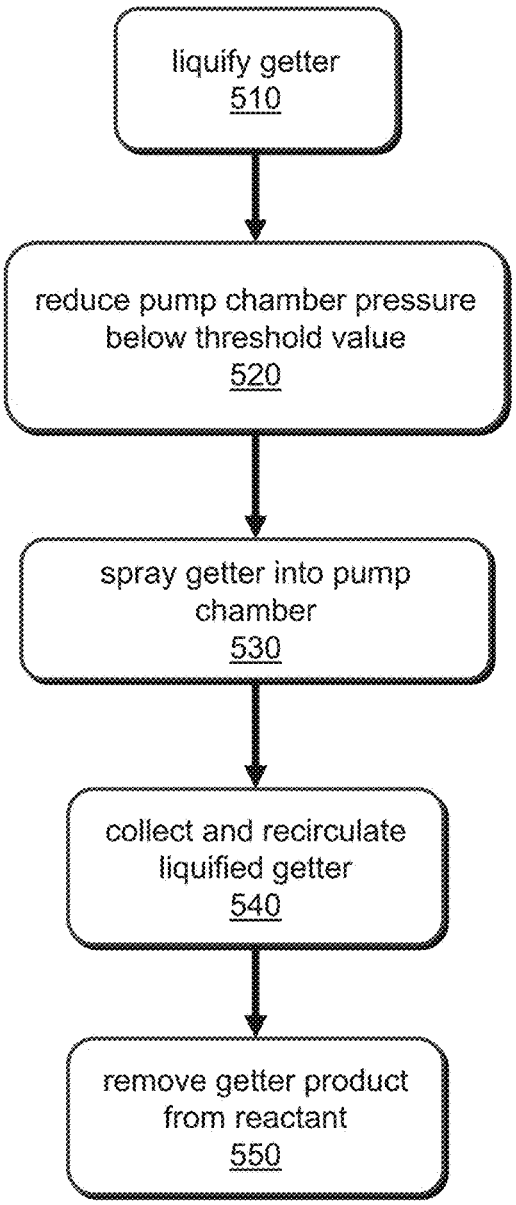
FIG. 5 illustrates a flow chart of acts associated with operation of a hybrid gettering diffusion pump.

FIG. 5 illustrates a flow chart of acts associated with operation of a hybrid gettering diffusion pump 110, 111. A method of operating a hybrid pump may include some, all, or more acts than those shown in FIG. 5. In some implementations, a method of operating a hybrid pump includes liquefying (act 510) a getter 260 that will chemically bind with a gaseous substance and reducing (act 520) a pump chamber pressure below a threshold value. The threshold value may be a value in a range from approximately or exactly $10^{-3}$ Torr to approximately or exactly $10^{-6}$ Torr. The reduced pressure may intentionally limit the amount of chemical reaction that can occur at a same time and extend the working life of the getter. After the threshold value is reached, the liquefied getter can be sprayed (act 530) into the pump chamber 205 creating a getter spray 247 that chemically binds with at least one gaseous substance in the pump chamber. After introduction of the getter spray, the chamber pressure may reduce to $10^{-8}$ Torr or lower. The method may further include collecting and recirculating (act 540) liquefied getter. The method may also include removing (act 550) getter product from the liquefied getter (e.g., with a getter processor 320, as described above).

Figure 6:
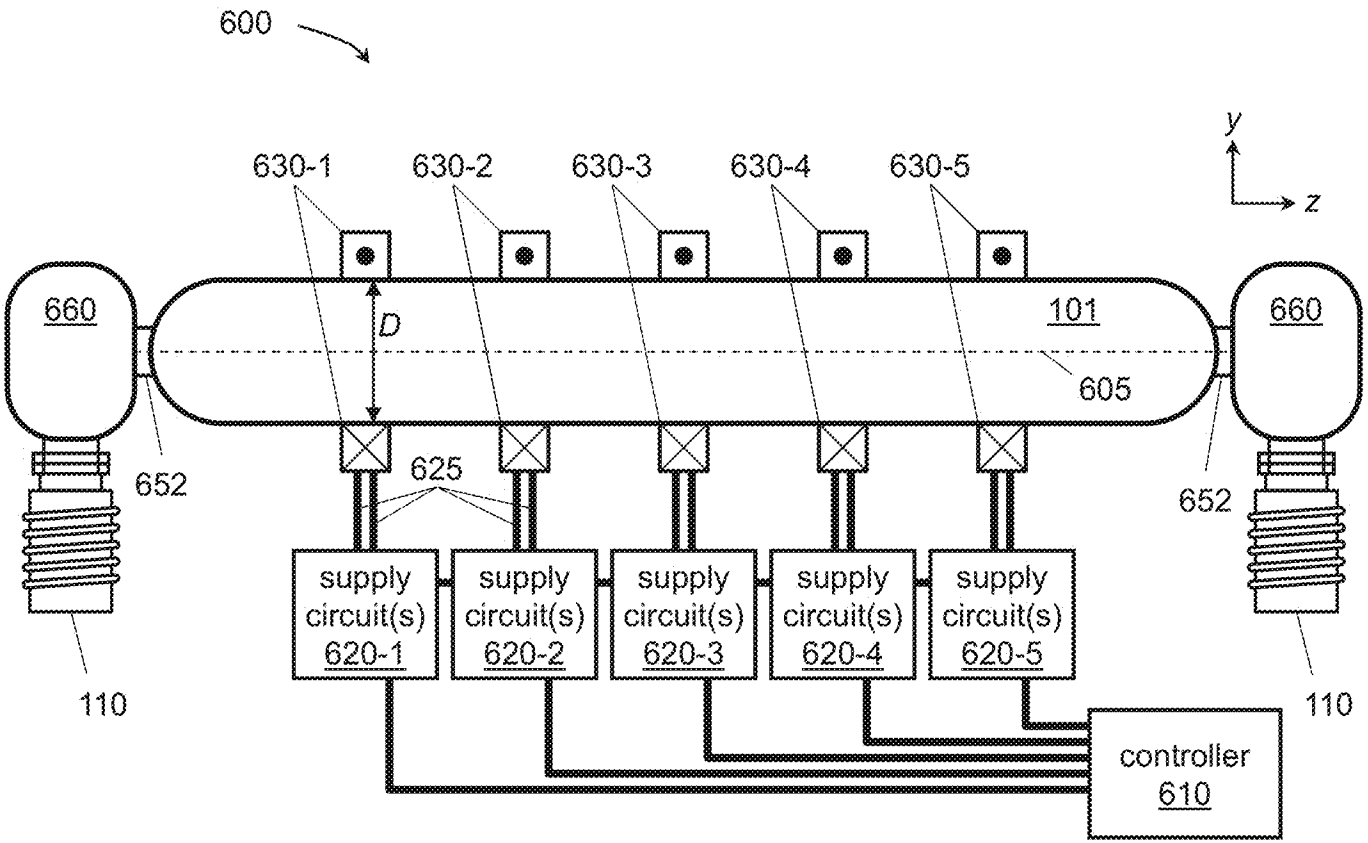
FIG. 6 depicts an example of a system that can include a hybrid gettering diffusion pump.

FIG. 6 depicts an example of a magnetic field system 600 that can be used to produce intense, dynamic magnetic fields (e.g., peak field values between 0.01 Tesla (T) and 50 T). The magnetic fields can be used to contain and control hot plasmas with the system's vacuum chamber 101. The system 600 includes a plurality of magnetic coils 630-1, 630-2, . . . 630-5 that can be arranged to cooperatively produce a magnetic field within the vacuum chamber 101. To cooperatively produce a magnetic field, the magnetic coils 630 can be spaced near enough to each other so that the magnetic field produced by any one coil adds to the magnetic field produced in the vacuum chamber 101 by at least one other coil in the system. For example, the space between adjacent coils 630-2, 630-3 can be equal to or less than the inner diameter D of the coil. In the illustration, the vacuum chamber 101 and magnetic coils 630 are depicted in a cross-sectional view. The vacuum chamber 101 may be made from stainless steel and/or other vacuum-compatible materials.

The magnetic coils 630, when driven by large electrical currents, can produce intense magnetic fields within the vacuum chamber 101. The vacuum chamber can be located adjacent to the magnetic coils 630 or may surround the magnetic coils. The magnetic field produced by the coils 630 can confine, shape, and control movement of the plasma along an axis 605 within the vacuum chamber 101. The electrical currents can be provided to the magnetic coils 630 through supply lines 625 from supply circuits 620-1, 620-2, 620-3, 620-4, 620-5. The timed delivery and amounts of the electrical currents can be controlled, at least in part, by a controller 610 (e.g., a logic circuit, programmable logic circuit, microcontroller, field-programmable gate array, digital signal processor, microprocessor, or some combination thereof).

For the illustrated example, the vacuum chamber 101 includes at least one vacuum port 652 through which a plasma can be introduced into and removed from the vacuum chamber. The system 600 further includes at least one plasma formation chamber 660 that can connect to the vacuum port(s) 625. At least one hybrid gettering diffusion pump 610 can couple to a plasma formation chamber 660 to evacuate the plasma formation chamber and main vacuum chamber 101.

At least one hot plasma can be formed in the plasma formation chamber(s) 660 and then injected into the vacuum chamber 101. In the illustrated example, two plasmas can be injected from each end of an elongated vacuum chamber and accelerated towards each other to collide at a center of the vacuum chamber 101. The collision can include a controlled merging of the injected plasmas. The merged plasmas can then be compressed by the magnetic coils 630, resulting in fusion or other nuclear transformation of some atoms within the merged plasma. The fusion can produce energetic particles (e.g., hot protons and neutrons or other products of the nuclear collisions).

After compression, the hot plasma can be ejected from the vacuum chamber 101 and can enter into the pump chamber(s) of the hybrid gettering diffusion pump(s) 110 where the hot plasma may come into contact with the getter spray 247 (shown in FIG. 2 and FIG. 3). The plasma can thereby transfer heat (e.g., through collisions) to the getter material in the spray which in turn can transfer heat to the getter liquid 260. The transfer of heat can help maintain the getter material in a liquid state. Additionally, energetic particles from fusion or other reactions in the vacuum chamber 101 may travel to the gettering diffusion pump(s) 110 and heat directly (e.g., through particle collisions) and/or indirectly (e.g., through nuclear or chemical interactions) getter material in the getter spray 247 which in turn can transfer heat to the getter liquid 260. In some cases, the entrapment of a gaseous substance by the getter can be an exothermic reaction (e.g., chemical or nuclear reaction) that heats the getter product 262 and subsequently heats the getter liquid 260.

In a system such as that shown in FIG. 6, the pressures in the vacuum chamber 101 and pump chamber(s) of the gettering diffusion pump(s) 110 can be relatively high compared to other low or ultra-low vacuum applications. For example, the pressures in the vacuum chamber 101 and pump chamber can be in a range from 1 Torr to $10^{-5}$ Torr, though lower pressures may be implemented in some applications. Additionally, the pressures in the vacuum chamber 101 and pump chamber may fluctuate in a cyclic manner during operation of the system 600. In steady state, the pressure(s) in the pump chamber(s) can be lower than the pressure in the vacuum chamber 101 by a factor having a value in a range from 1 to 10, for example. As an example, the pressure in the vacuum chamber may be $10^{-1}$ Torr and the pressure in the pump chamber(s) a factor of 2 lower (i.e., $5\times10^{-2}$ Torr). In transient, pulsed, or cyclical operation of the system 600 (such as involving repeated cycles of injecting, manipulating, and then evacuating a plasma within the vacuum chamber 101) the pressure differential between the vacuum chamber 101 and pump chamber 110 can be higher during some or all of the transient period, during a time period following each pulse, or during at least a portion of an operational cycle. For example, after injection of the plasma, the pressure differential can be from 10 to $10^6$, for example. The getter spray(s) 247 in the gettering diffusion pump(s) 110 may not be initiated in the system 600 until the pressure in the pump chamber(s) is in a range from 1 Torr to $10^{-4}$ Torr. Initiating the getter spray(s) 247 can lower the pressure(s) in the pump chamber(s) and vacuum chamber to $10^{-5}$ Torr or lower. In some cases, the getter spray(s) 247 in the gettering diffusion pump(s) 110 may not be initiated in the system 600 until the pressure in the pump chamber(s) is in a range from 1 Torr to $10^{-5}$ Torr, and initiating the getter spray(s) 247 can lower the pressure(s) in the pump chamber(s) and vacuum chamber to $10^{-6}$ Torr or lower.

As one example of operation, the getter spray(s) 247 may be initiated when the vacuum chamber 101 and pump chamber 205 both have a same pressure in a range of 1 Torr to $10^{-5}$ Torr. When initially pumping down the vacuum chamber 101, the pressure differential between the pump chamber(s) 205 of the gettering diffusion pump(s) 110 and the vacuum chamber 101 can increase to as much as $10^3$ or more while the gettering diffusion pump(s) 110 pulls or pull the vacuum in the vacuum chamber down to a base pressure (which could be in a range from $10^{-3}$ to $10^{-9}$ or lower. To start an operational cycle of the system 600, a plasma, gas, or particles may be injected into the vacuum chamber 101, which rapidly elevates the pressure in the chamber 101 and increases the pressure differential up to $10^6$ or higher. The gettering diffusion pump(s) 110 can then evacuate the vacuum chamber 101 during a subsequent portion of the operational cycle to a minimum cyclic pressure. The minimum cyclic pressure can be higher than the base pressure achieved when initially pumping down the vacuum chamber 101. For example, the minimum cyclic pressure may be in a range from $10^{-2}$ Torr to 10 Torr. When the minimum cyclic pressure is reached, the plasma, gas, or particles can be injected again into the vacuum chamber 101 to start a next cycle of operation, and the cycles can be repeated. When the minimum cyclic pressure is reached, the pressure(s) in the pump chamber(s) 205 can be lower than the pressure in the vacuum chamber 101 by a factor having a value in a range from 1 to 10, for example.

The hybrid gettering diffusion pump and methods of operating the pump can be implemented in different configurations, some examples of which are listed below.

(1) A vacuum pump comprising: a pump chamber; a pump wall surrounding the pump chamber; a getter region to hold a getter, wherein the getter region is coupled to the pump chamber; a heater thermally coupled to the getter region to liquefy the getter in the getter region; and at least one injector fluidically coupled to the getter region and arranged to spray liquefied getter from the getter region into the pump chamber.

(2) The vacuum pump of configuration (1), wherein, in operation, the pump chamber includes a first substance in gaseous form and the getter spray contains a second substance that chemically binds with the first substance to remove the first substance from the pump chamber.

(3) The vacuum pump of configuration (1) or (2), further comprising the getter, wherein the getter comprises lithium.

(4) The vacuum pump of configuration (1) or (2), further comprising the getter, wherein the getter comprises sodium.

(5) The vacuum pump of configuration (1) or (2), further comprising the getter, wherein the getter comprises a compound.

(6) The vacuum pump of configuration (1) or (2), further comprising the getter, wherein the getter comprises an alloy.

(7) The vacuum pump of any one of configurations (1) through (6), further comprising a valve to seal off the getter region from the pump chamber.

(8) The vacuum pump of any one of configurations (1) through (7), further comprising: a vacuum port coupler connected to the pump wall; and a vacuum port baffle located in or adjacent to the vacuum port coupler, wherein the vacuum port baffle aids in preventing backstreaming of getter spray particles and/or gaseous substances through the vacuum port coupler.

(9) The vacuum pump of any one of configurations (1) through (8), further comprising an electromagnetic induction pump fluidically coupled between the getter region and the at least one injector to pump the liquefied getter to the at least one injector.

(10) The vacuum pump of any one of configurations (1) through (9), wherein the heater is a first heater, further comprising a second heater configured to heat the liquefied getter prior to injection into the pump chamber by the at least one injector.

(11) The vacuum pump of any one of configurations (1) through (10), further comprising: a foreline coupler to couple the vacuum pump to a backing pump; and a chamber baffle arranged in the pump chamber to elevate pressure within the pump chamber near the foreline coupler.

(12) The vacuum pump of configuration (11), wherein the backing pump is configured to evacuate the pump chamber.

(13) The vacuum pump of configuration (11) or (12), wherein the elevated pressure allows removal of gas near the foreline coupler by the backing pump.

(14) The vacuum pump of any one of configurations (11) through (13), wherein the chamber baffle is thermally coupled with the pump wall.

(15) The vacuum pump of any one of configurations (1) through (14), further comprising a fluid port coupled to the getter region to remove the liquefied getter from the getter region.

(16) The vacuum pump of any one of configurations (1) through (15), further comprising: a getter processor fluidically coupled to the getter region to receive the liquefied getter containing an amount of a solid product produced by chemical binding of the liquefied getter that is sprayed into the pump chamber with a gaseous substance in the pump chamber, to separate at least a portion of the solid product from the liquefied getter, and to output the liquefied getter containing a smaller amount of the solid product; a getter return tube coupled between the getter region and the getter processor; and a getter feed tube coupled between the getter processor and the getter region.

(17) A system comprising the vacuum pump of any one of configurations (1) through (16) in combination with a vacuum chamber in which to perform a process, wherein the vacuum pump is coupled to the vacuum chamber to remove gas from the vacuum chamber.

(18) The system of configuration (17), wherein the process is fusion of two nuclei.

(19) The system of configuration (17), wherein the process produces x-rays, extreme ultraviolet rays, electrons, or ions.

(20) A method of operating a vacuum pump, the method comprising: liquefying a getter to form a liquefied getter in a getter region of the vacuum pump; reducing a pressure in a pump chamber of the vacuum pump below a threshold value; injecting the liquefied getter into the pump chamber to chemically bind with a gaseous substance in the pump chamber and to remove the bound gaseous substance from the pump chamber, wherein the chemical binding forms a getter product; and receiving the liquefied getter sprayed into the pump chamber and the getter product in the getter region.

(21) The method of (20), wherein the getter is lithium.

(22) The method of (20), wherein the getter is sodium.

(23) The method of (20), wherein the getter is a compound.

(24) The method of (20), wherein the getter is an alloy.

(25) The method of any one of (20) through (24), wherein the gaseous substance comprises hydrogen.

(26) The method of any one of (20) through (24), wherein the gaseous substance comprises oxygen.

(27) The method of any one of (20) through (24), wherein the gaseous substance comprises carbon dioxide.

(28) The method of any one of (20) through (24), wherein the gaseous substance comprises carbon monoxide.

(29) The method of any one of (20) through (24), wherein the gaseous substance comprises nitrogen.

(30) The method of any one of (20) through (24), wherein the gaseous substance comprises an organic vapor.

(31) The method of any one of (20) through (24), wherein the gaseous substance comprises a hydrocarbon.

(32) The method of any one of (20) through (31), further comprising recirculating the liquefied getter that is received to inject again into the pump chamber.

(33) The method of any one of (20) through (32), further comprising removing at least a portion of the getter product from the liquefied getter.

(34) The method of (33), wherein removing at least the portion of the getter product comprises: converting the getter product to the liquefied getter and a gas; and separating the gas from the liquefied getter.

(35) The method of (33), wherein removing at least the portion of the getter product comprises filtration of the getter product from the liquefied getter.

(36) The method of any one of (20) through (35), wherein reducing the pressure in the pump chamber comprises creating a vacuum level in the pump chamber having a value in a range from approximately 1 Torr to approximately $10^{-5}$ Torr before injecting the liquefied getter into the pump chamber.

(37) The method of (36), creating the vacuum level comprises evacuating the pump chamber with a backing pump coupled to the pump chamber.

(38) The method of any one of (20) through (37), further comprising heating the liquefied getter with a heater prior to injecting the liquefied getter into the pump chamber, wherein the heating vaporizes the liquefied getter.

(39) The method of any one of (20) through (38), further comprising operating the vacuum pump for at least 100 hours without replacing the liquefied getter.

(40) The method of any one of (20) through (39), further comprising: inducing molecular flow to a second gaseous substance in the pump chamber by imparting kinetic energy to the second gaseous substance with the injected liquefied getter to move the second gaseous substance to an foreline port that is coupled to the pump chamber; and removing, through the foreline port, at least a portion of the second gaseous substance that was moved to the foreline port.

(41) The method of any one of (20) through (40), further comprising reducing backstreaming of the gaseous substance and particles from the liquefied getter with a vacuum port baffle that is located withing or adjacent to a vacuum port coupler of the vacuum pump, wherein the vacuum port coupler is configured to couple to a vacuum chamber.

(42) The method of any one of (20) through (41), further comprising receiving heat by the liquefied getter, wherein the heat is generated, at least in part, from a plasma that enters the pump chamber.

(43) The method of any one of (20) through (42), further comprising receiving heat by the liquefied getter, wherein the heat is generated, at least in part, from collisions between first atoms or first particles of the liquefied getter that is injected into the pump chamber and second atoms or second particles that enter the pump chamber.

(44) The method of any one of (20) through (43), further comprising receiving heat by the liquefied getter, wherein the heat is generated, at least in part, from a chemical reaction between first atoms or first particles of the liquefied getter that is injected into the pump chamber and second atoms or second particles that enter the pump chamber.

(45) The method of any one of (20) through (44), further comprising receiving heat by the liquefied getter, wherein the heat is generated, at least in part, from a nuclear interaction between first atoms of the liquefied getter that is injected into the pump chamber and second atoms that enter the pump chamber.

(46) The method of any one of (1) through (45), wherein reducing the pressure in the pump chamber comprises temporarily creating a pressure differential of up to $10^6$ between the pressure in the pump chamber and a chamber pressure in a vacuum chamber that is coupled to the vacuum pump.

CONCLUSION

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain, using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the components so conjoined, i.e., components that are conjunctively present in some cases and disjunctively present in other cases. Multiple components listed with "and/or" should be construed in the same fashion, i.e., "one or more" of the components so conjoined. Other components may optionally be present other than the components specifically identified by the "and/or" clause, whether related or unrelated to those components specifically identified. Thus, as a non-limiting example, a reference to "A and/or B", when used in conjunction with open-ended language such as "comprising" can refer, in one embodiment, to A only (optionally including components other than B); in another embodiment, to B only (optionally including components other than A); in yet another embodiment, to both A and B (optionally including other components); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of components, and, optionally, additional unlisted items. Only terms clearly indicated to the contrary, such as "only one of" or "exactly one of," or, when used in the claims, "consisting of," will refer to the inclusion of exactly one component of a number or list of components. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more components, should be understood to mean at least one component selected from any one or more of the components in the list of components, but not necessarily including at least one of each and every component specifically listed within the list of components and not excluding any combinations of components in the list of components. This definition also allows that components may optionally be present other than the components specifically identified within the list of components to which the phrase "at least one" refers, whether related or unrelated to those components specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including components other than B); in another embodiment, to at least one, optionally including more than one, B, with no A present (and optionally including components other than A); in yet another embodiment, to at least one, optionally including more than one, A, and at least one, optionally including more than one, B (and optionally including other components); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A vacuum pump comprising:

a pump chamber;

a pump wall surrounding the pump chamber;

a vacuum port into the pump chamber to fluidically couple the pump chamber to a vacuum chamber located external to the pump chamber;

an exhaust port into the pump chamber to fluidically couple the pump chamber to a backing pump for removal of gas from the pump chamber;

a getter region to hold a getter, wherein the getter region is coupled to the pump chamber;

a heater thermally coupled to the getter region to liquefy the getter in the getter region;

a valve to seal off the getter region from the pump chamber;

a foreline coupler to couple the exhaust port to a backing pump;

a chamber baffle arranged in the pump chamber to elevate pressure within the pump chamber near the exhaust port; and at least one injector fluidically coupled to the getter region and arranged to spray liquefied getter from the getter region into the pump chamber to remove a gaseous substance of the gas from the pump chamber by chemically binding of the gaseous substance with the sprayed liquefied getter, wherein the at least one injector is arranged to spray the liquefied getter in a direction to move the gas within the pump chamber towards the exhaust port for evacuation from the pump chamber.

2. The vacuum pump of claim 1, wherein, in operation, the getter spray contains lithium that chemically binds with the gaseous substance to remove the gaseous substance from the pump chamber.

3. The vacuum pump of claim 1, further comprising the getter, wherein the getter comprises at least one of lithium, sodium, a compound, or an alloy.

4. The vacuum pump of claim 1, further comprising:

a vacuum port coupler connected to the vacuum port; and a vacuum port baffle located in or adjacent to the vacuum port coupler, wherein the vacuum port baffle aids in preventing backstreaming of getter spray particles and/or gaseous substances through the vacuum port coupler.

5. The vacuum pump of claim 1, further comprising:

an electromagnetic induction pump fluidically coupled between the getter region and the at least one injector to pump the liquefied getter to the at least one injector.

6. The vacuum pump of claim 1, wherein the heater is a first heater, and further comprising a second heater configured to heat the liquefied getter prior to injection into the pump chamber by the at least one injector.

7. The vacuum pump of claim 1, further comprising the backing pump configured to evacuate the pump chamber.

8. The vacuum pump of claim 1, wherein the elevated pressure allows removal of gas near the exhaust port by the backing pump.

9. The vacuum pump of claim 1, wherein the chamber baffle is thermally coupled with the pump wall.

10. The vacuum pump of claim 1, further comprising a fluid port coupled to the getter region to remove the liquefied getter from the getter region.

11. The vacuum pump of claim 1, further comprising:

a getter processor fluidically coupled to the getter region to receive the liquefied getter containing an amount of a solid product produced by chemical binding of the liquefied getter that is sprayed into the pump chamber with the gaseous substance in the pump chamber, to separate at least a portion of the solid product from the liquefied getter, and to output the liquefied getter containing a smaller amount of the solid product;

a getter return tube coupled between the getter region and the getter processor; and a getter feed tube coupled between the getter processor and the getter region.

12. A system comprising the vacuum pump of claim 1 in combination with a vacuum chamber in which to perform a process, wherein the vacuum pump is coupled to the vacuum chamber to remove gas from the vacuum chamber.

13. The system of claim 12, wherein the process is fusion of two nuclei.

14. The system of claim 12, wherein the process produces x-rays, extreme ultraviolet rays, electrons, or ions.

* * * * *